US006927647B2

(12) United States Patent
Starri et al.

(10) Patent No.: US 6,927,647 B2
(45) Date of Patent: Aug. 9, 2005

(54) TWO CHANNELS, HIGH SPEED, RF SWITCH

(76) Inventors: Ernesto G. Starri, P.O. Box 1934, 1420 San Ponte Rd., Corona, CA (US) 92878; David V. Kane, 30 Millies Way, Dunbarton, NH (US) 03046

( * ) Notice: Subject to any disclaimer, the term of this patent is extended or adjusted under 35 U.S.C. 154(b) by 66 days.

(21) Appl. No.: 10/458,762

(22) Filed: Jun. 10, 2003

(65) Prior Publication Data

US 2004/0036552 A1 Feb. 26, 2004

Related U.S. Application Data

(60) Provisional application No. 60/387,611, filed on Jun. 11, 2002.

(51) Int. Cl.[7] ..... H01P 5/12
(52) U.S. Cl. ..... 333/103; 333/25; 333/104
(58) Field of Search ..... 333/25, 103, 101, 333/104, 258, 262

(56) References Cited

U.S. PATENT DOCUMENTS

| | | | | |
|---|---|---|---|---|
| 4,193,048 A | | 3/1980 | Nyhus | 333/26 |
| 4,417,157 A | | 11/1983 | Gershberg et al. | 307/256 |
| 4,527,134 A | | 7/1985 | Wantuch | 333/1.1 |
| 4,987,392 A | * | 1/1991 | Clark et al. | 333/103 |
| 5,054,114 A | | 10/1991 | Erickson | 455/78 |
| 5,061,910 A | | 10/1991 | Bouny | 333/26 |
| 5,144,319 A | | 9/1992 | Roberts | 342/372 |
| 5,304,960 A | | 4/1994 | Das | 333/101 |
| 5,697,088 A | | 12/1997 | Gu | 455/307 |
| 5,708,377 A | | 1/1998 | Bradley | 327/91 |
| 6,009,314 A | | 12/1999 | Bjork et al. | 455/83 |
| 6,114,940 A | | 9/2000 | Kakinuma et al. | 336/233 |
| 6,133,790 A | * | 10/2000 | Zhou | 330/149 |
| H1959 H | | 5/2001 | Kikel | 342/51 |
| 6,239,668 B1 | | 5/2001 | Menna et al. | 333/25 |
| 6,252,460 B1 | | 6/2001 | Ito | 330/301 |
| 6,459,885 B1 | | 10/2002 | Burgess | 455/83 |
| 6,466,770 B1 | | 10/2002 | Griffith et al. | 455/91 |
| 6,531,943 B2 | | 3/2003 | Niu et al. | 336/182 |

* cited by examiner

*Primary Examiner*—Daniel Chang
(74) *Attorney, Agent, or Firm*—Bourque & Associates

(57) ABSTRACT

A dual channel, RF switch with broadband frequency response is provided wherein an RF signal input to a transformer is provided to a first and second biasing circuit. Each biasing circuit includes one or more DC blocking capacitors and a biasing PIN diode. Thus the biasing circuit provides an RF output to an output port. A biasing circuit control signal selectively controls each biasing circuit. When a biasing circuit is biased, it presents a very low resistance to the output load, while in an unbiased condition; the biasing circuit provides a very high resistance or impedance to the output load. The PIN diode provides for a biasing element through which the RF signal does not flow.

29 Claims, 7 Drawing Sheets

TWO CHANNELS, HIGH SPEED, RF SWITCH

CROSS-REFERENCE TO RELATED APPLICATIONS

This application claims the benefit of U.S. Provisional Patent Application No. 60/387,611 filed Jun. 11, 2002, and fully incorporated herein by reference.

TECHNICAL FIELD

The present invention relates to RF switches and more particularly, to a two channel, high speed RF switch.

BACKGROUND INFORMATION

There are presently known solid-state RF switches which are utilized to control, switch or redirect RF energy in various applications, such as radar signals, and RF commutators. Those presently available solid-state RF switches, although faster than mechanical commutators, are too slow. In many applications, it is required to commutate the RF signal from one port to another in a time frame of less than 30 microseconds.

For example, in those applications where it is desired to switch off an RF transmitter and to turn on an RF receiver in less than a millisecond, the present solid state switches are unable to switch quickly enough.

The presently available RF solid-state switches do not provide enough isolation when the load to which RF energy is directed has a poor VSWR (Voltage Standing Wave Ratio) that is; the load is not properly terminated with the correct impedance. When such switches are used to switch between antennas or filters, it is impractical to assume that these elements are all properly terminated under all conditions. As a result, it is common to use a heavier-duty switch which is power overrated to maintain sufficient isolation, but at considerable cost in terms of the system that the switch is utilized in. However, even using an overrated switch will not withstand a short or an open circuit, and thus will fail to maintain isolation between ports and cause unwanted cross-talk.

An additional problem in present solid-state RF switches is that the RF energy is transmitted in a direct path through PIN diodes. Unfortunately PIN diodes are non-linear devices and accordingly, there is a significant amount of unwanted signal produced such as second, third and higher order intermodulation products and harmonics, which distorts and otherwise degrades the desired RF signal.

The present solid-state RF switches require high voltage to operate. Typically voltages higher than 100V or several 1000 may be required. The prior art switches also cannot switch without some sort of ringing and annoying amplitude shaping caused by the present architecture.

Finally, presently available solid-state RF switch architectures do not perform well in broadband applications and perform better in a narrow band environment, with all the difficulties mentioned above still being present. In order to provide a response to wider signal band, multiple solid-state RF switches must be employed.

SUMMARY

Accordingly, the present invention provides a two channel, high speed RF switch which responds to a broad frequency band of, for example, without limitation, 1 to 50 MHz or 100 to 1,000 MHz; up to several GHz, which can switch very rapidly, in the order of 1 microsecond to 20 microseconds; and which does not route the RF energy directly through a PIN diode thus eliminating harmonics and other unwanted higher insertion losses (RF energy attenuation problems). The isolation across the channel paths of the present switch is relatively immune to load VSWR and does not require high voltages to operate. The architecture is such that ringing is virtually non-existent.

Accordingly, the present invention features a dual channel RF switch having one input and two outputs. According to the present invention, a biasing circuit feeds or controls each output. In an unbiased conditions, the biasing circuit prevents a high impedance to a load connected to the output while in a biased condition, the biasing circuit offers little resistance to an RF signal transmitted to the load.

In accordance with the teachings from the present invention, the biasing circuit includes one or more PIN diodes which are used to bias or unbias the biasing circuit, but through which no RF energy flows.

According to various embodiments of the invention, DC current blocking capacitors may be provided in the biasing circuit as well as injection inductors. The transformers may include BALUN transformers, broadband ferrite or iron powder loaded transformers wound with coaxial cable, and/or a coaxial cable having a length selected such that an RF signal phase at one output of the RF switch is the same as an RF signal phase at the output of another output of the RF switch.

BRIEF DESCRIPTION OF THE DRAWINGS

These and other features and advantages of the present invention will be better understood by reading the following detailed description, taken together with the drawings wherein.

DETAILED DESCRIPTION OF THE DRAWINGS

Figure 1:
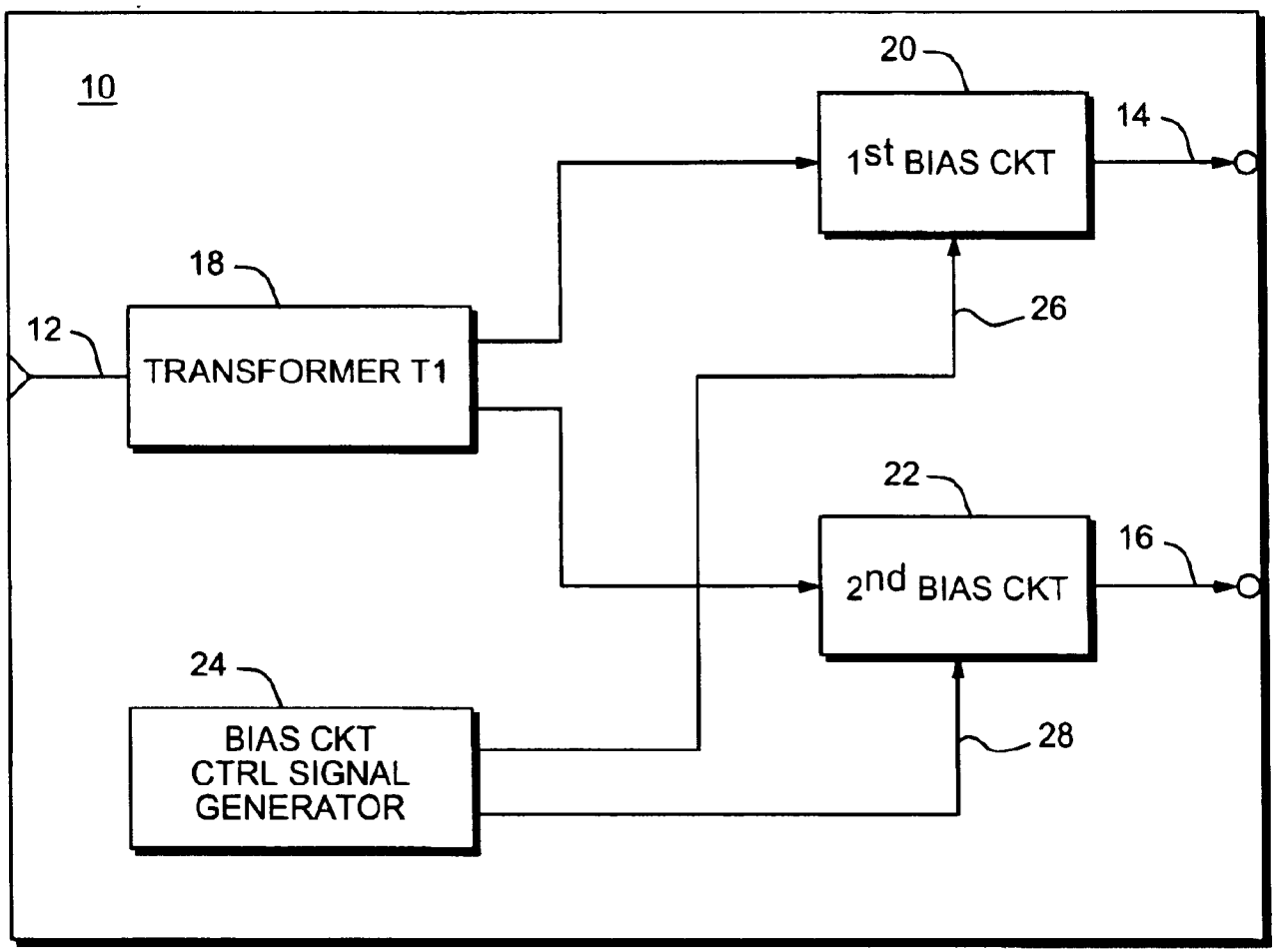
FIG. 1 is a block diagram of the RF switch according to the present invention.

The present invention features a dual channel RF switch 10, FIG. 1, adapted to take an RF signal provided at input 12 and provide the signal to one of two outputs 14 or 16. The RF signal at input 12 is received by a first transformer 18 and provided to both first and second biasing circuits 20, 22 respectively. During operation, only one biasing circuit will be biased, thus allowing the signal to pass to one of the outputs 14 or 16, while the other biasing circuit will be in a high impedance state.

Control of the first and second biasing circuits 20, 22 is provided by biasing circuit control signal generator 24 which selectively provides the first biasing circuit control signal 26 and a second biasing circuit control signal 28. The biasing circuit control signal generator 24 may take the form of any circuit that is able to selectively energize one or the other, but not both simultaneously, of the first and second biasing circuit control signals 26, 28.

Figure 2:
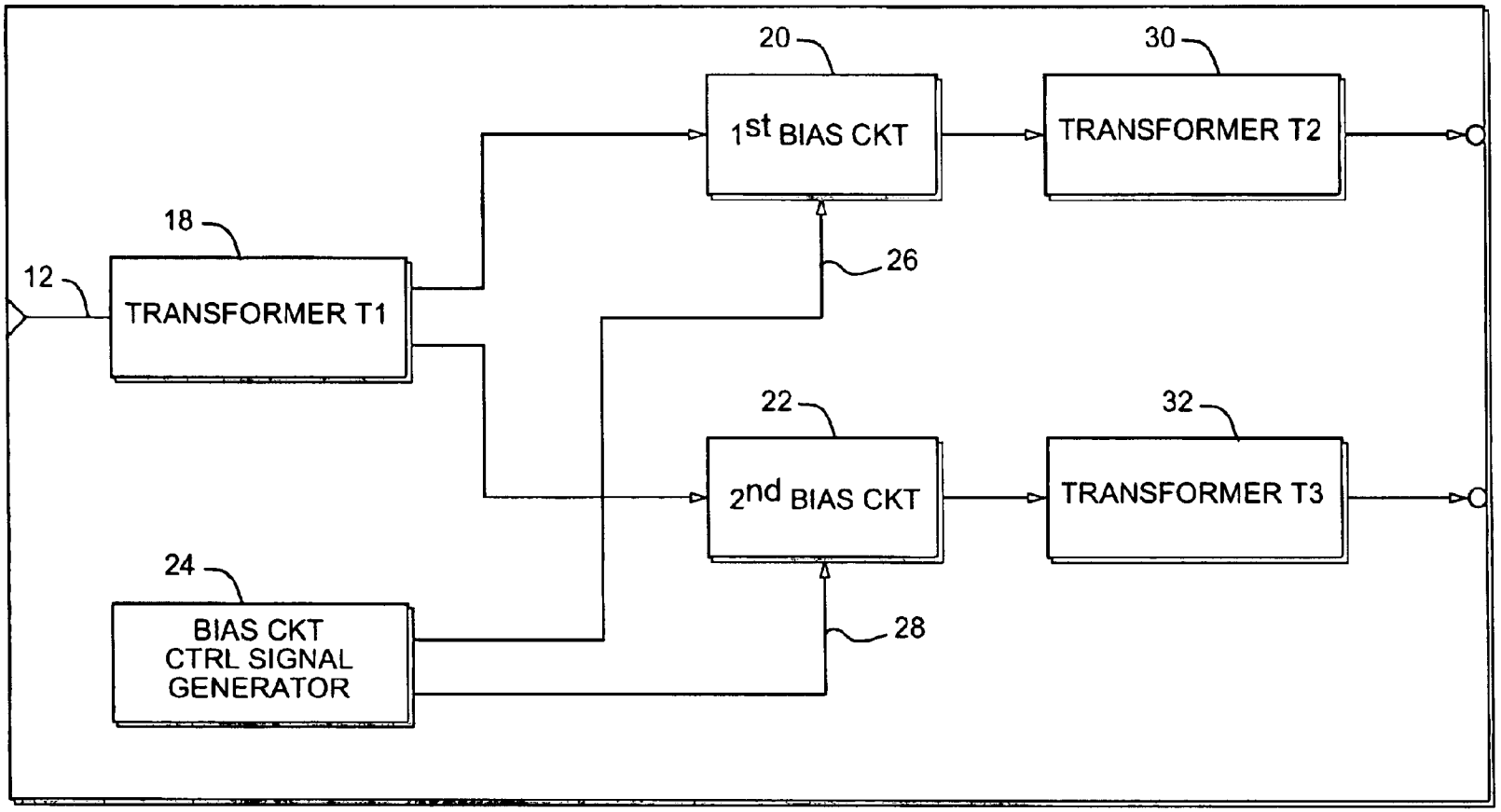
FIG. 2 is a block diagram of a second embodiment of the RF switch according to the present invention.

In another embodiment, shown in FIG. 2, the first biasing circuit 20 passes the RF signal to a second transformer 30. In a similar fashion, the second biasing circuit 22 passes the RF signal to a third transformer 32.

In a first embodiment, the transformers may be BALUN transformers. Alternatively, the transformers may include broadband ferrite loaded transformers wound with coaxial cable. An additional alternative transformer is a coaxial cable having a length selected such that an RF signal phase at one output port will match an RF signal phase at another output port.

Figure 3:
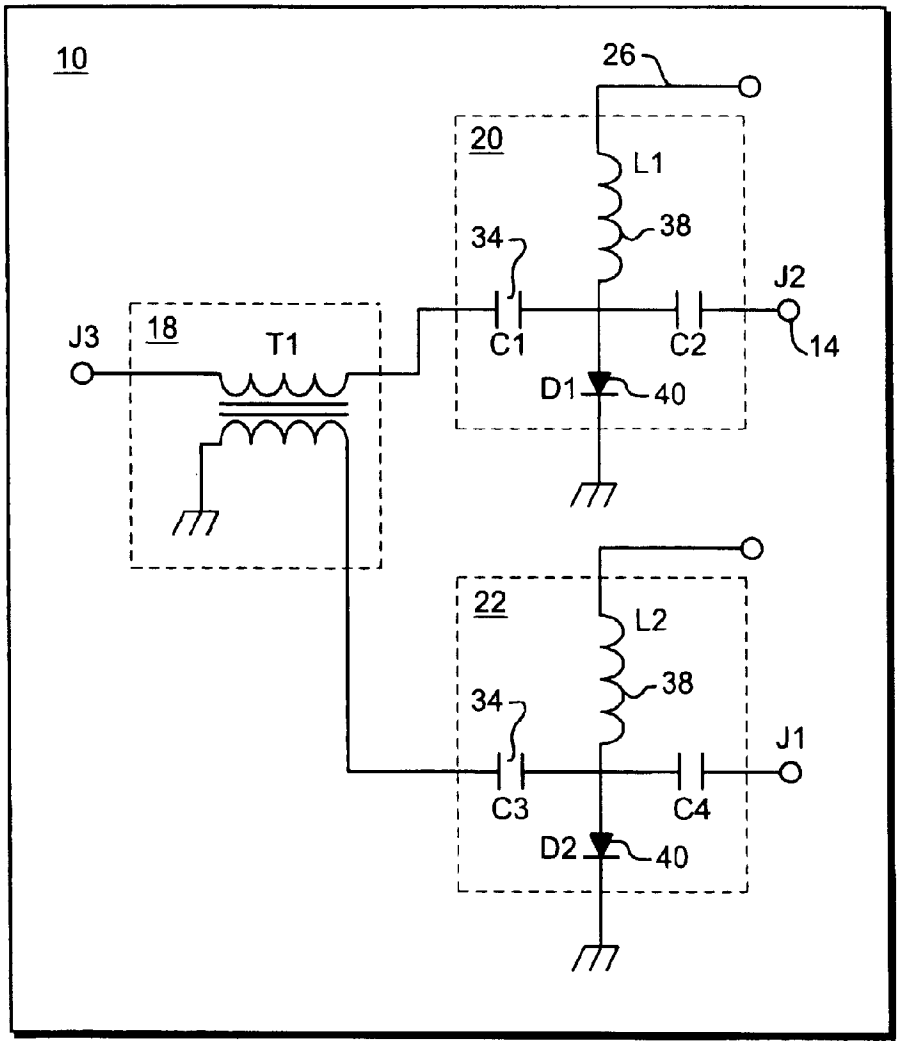
FIG. 3 is an electrical component schematic drawing of the first embodiment of the RF switch of the present invention.

As shown in greater detail in FIG. 3, the dual channel RF switch 10 is illustrated in the first embodiment with transformer 18 shown as a BALUN transformer. The first and second biasing circuits 20, 22 each include a first DC current blocking capacitor 34 (labeled C1 and C3) located between a first transformer T1 and the remainder of the biasing circuit. The first and second biasing circuits further include bias injection conductors 38 (labeled L1 and L2) which are coupled to one end of PIN diodes 40 while the other end of the injection inductors are connected to the biasing circuit control signal. The other end of the PIN diode is connected to ground.

In an unbiased condition, the PIN diode provides a high resistance, in the order of several thousands ohms while in a based condition, with a biasing current of in the order of several milliamps, the resistance changes to a very low resistance of approximately 0.2 ohms or less depending on the diodes used.

In use, when PIN diode 40, D1 is turned on by the appropriate control signal 26 (the biased condition), port 14 (labeled J2), is at a ground potential. The first transformer 18 then acts as a reversing BALUN and all of the power entering the input J3 is routed to J1, minus any transmission and core losses. Alternatively, when D2 is biased, T1 acts as a transmission line and the power appears at port J2. The signals, which appear at J1 or J2, are 180° out of phase with each other. Also, the low frequency response of the RF switch is somewhat different for the two paths (J3/J2 and J3/J1) due to the magnetizing path that exists for J3/J1, but not for J3/J2.

Figure 4:
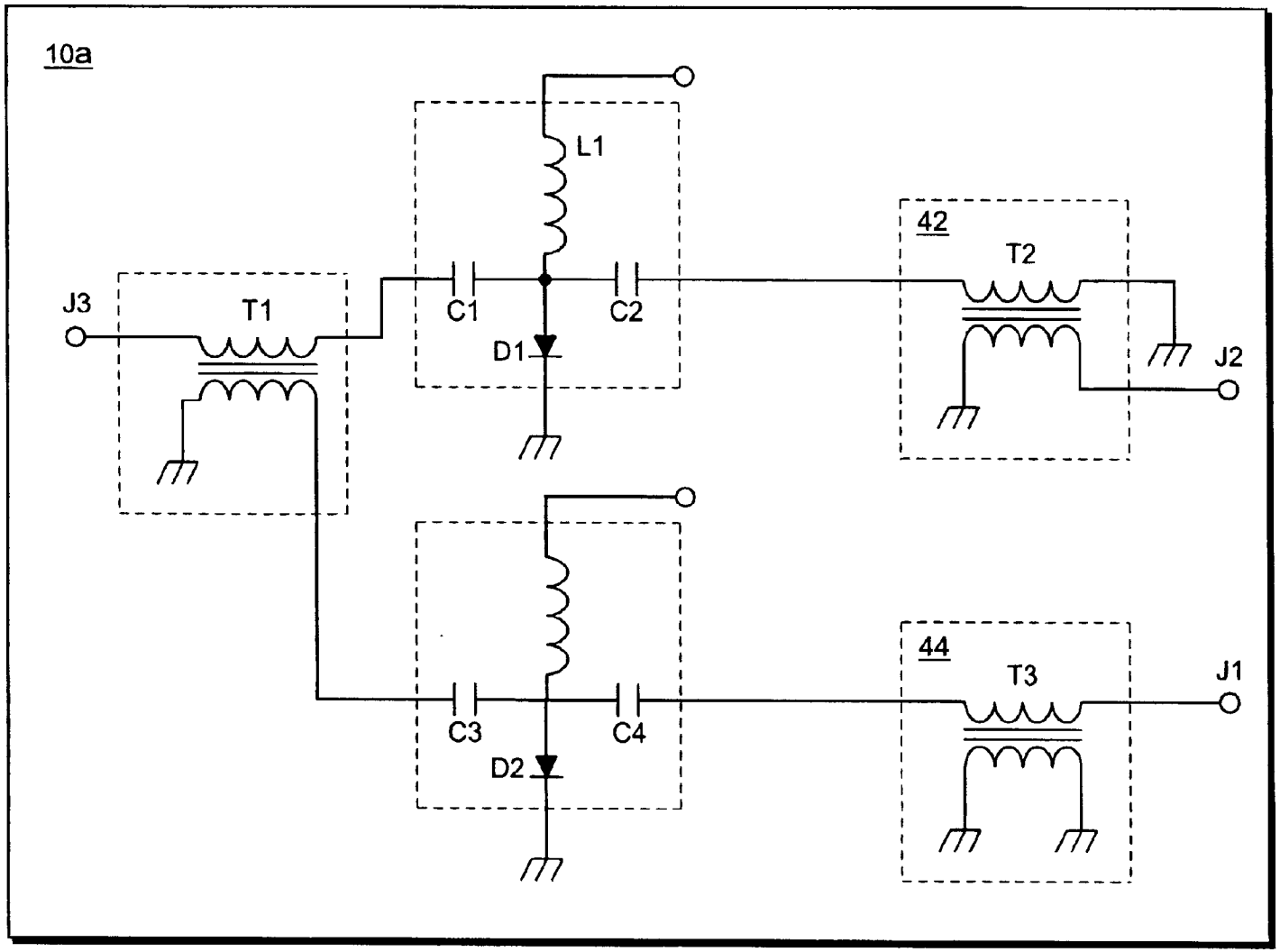
FIG. 4 is an electrical component schematic drawing of a second embodiment of the present invention.

FIG. 4 illustrates another embodiment 10*a* of the dual channel RF switch according to the present invention. The circuit shown in FIG. 4 corrects two shortcomings of FIG. 3. Since T1 introduces a phase shift of 180° to the J3/J1 path, and no phase shift of a similar fashion in the J3/J2 signal path, transformer 42 (labeled T2) introduces a 180° phase shift in the J3/J2 signal path, thus balancing the phases of the two output paths. Since T1 does introduce a transmission line phase shift in the J3/J2 signal path, the phases are balanced by introducing a similar phase shift utilizing transformer 44 (labeled T3). Since both signal paths now have magnetizing elements, they are balanced and provide excellent low frequency response as well.

Figure 5:
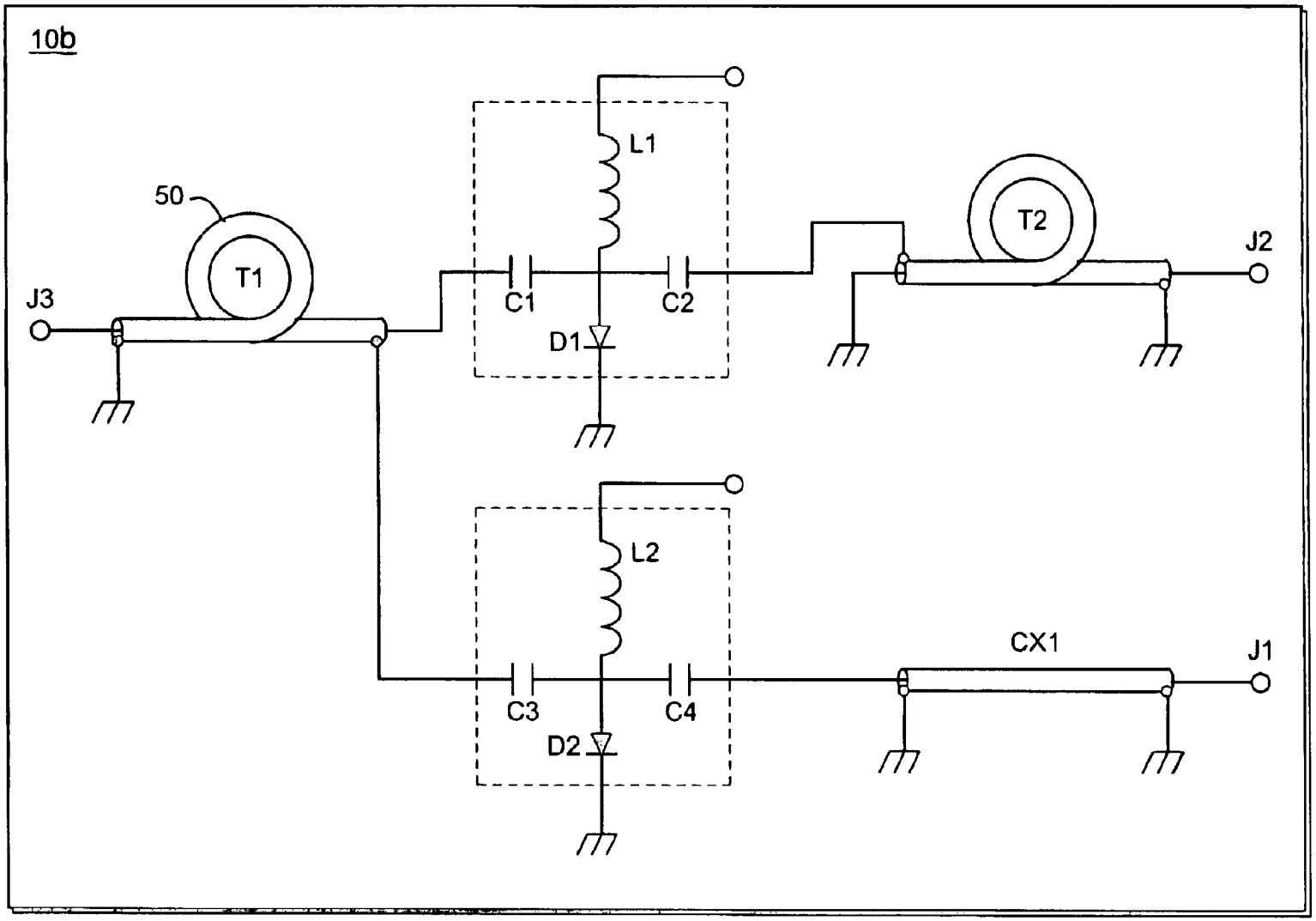
FIG. 5 is a electrical component schematic drawing of an RF switch according to a third embodiment according to the present invention.

FIG. 5 illustrates another embodiment 10*b* of the RF switch of the present invention, which adds further improvements by replacing one, or more of the BALUN transformers of the previous circuits with a broadband ferrite loaded transformer wound with coaxial cable of a set impedance. The transformer 50 can also be built without a ferrite at high frequencies. The transformer 50 may be built by winding multiple turns around a ferrite toroid, ferrite rod, or any other shaped ferrite or iron powder material. The transformer can also be built as a single turn through a ferrite or iron powder sleeve, depending on the frequency.

In the preferred embodiment, T2 is built in a similar manner. T3, however, may be replaced by coaxial cable having a length that is adjusted so that the phase in the J3/J2 signal path is the same as the phase in the J3/J1 signal path.

Figure 6:
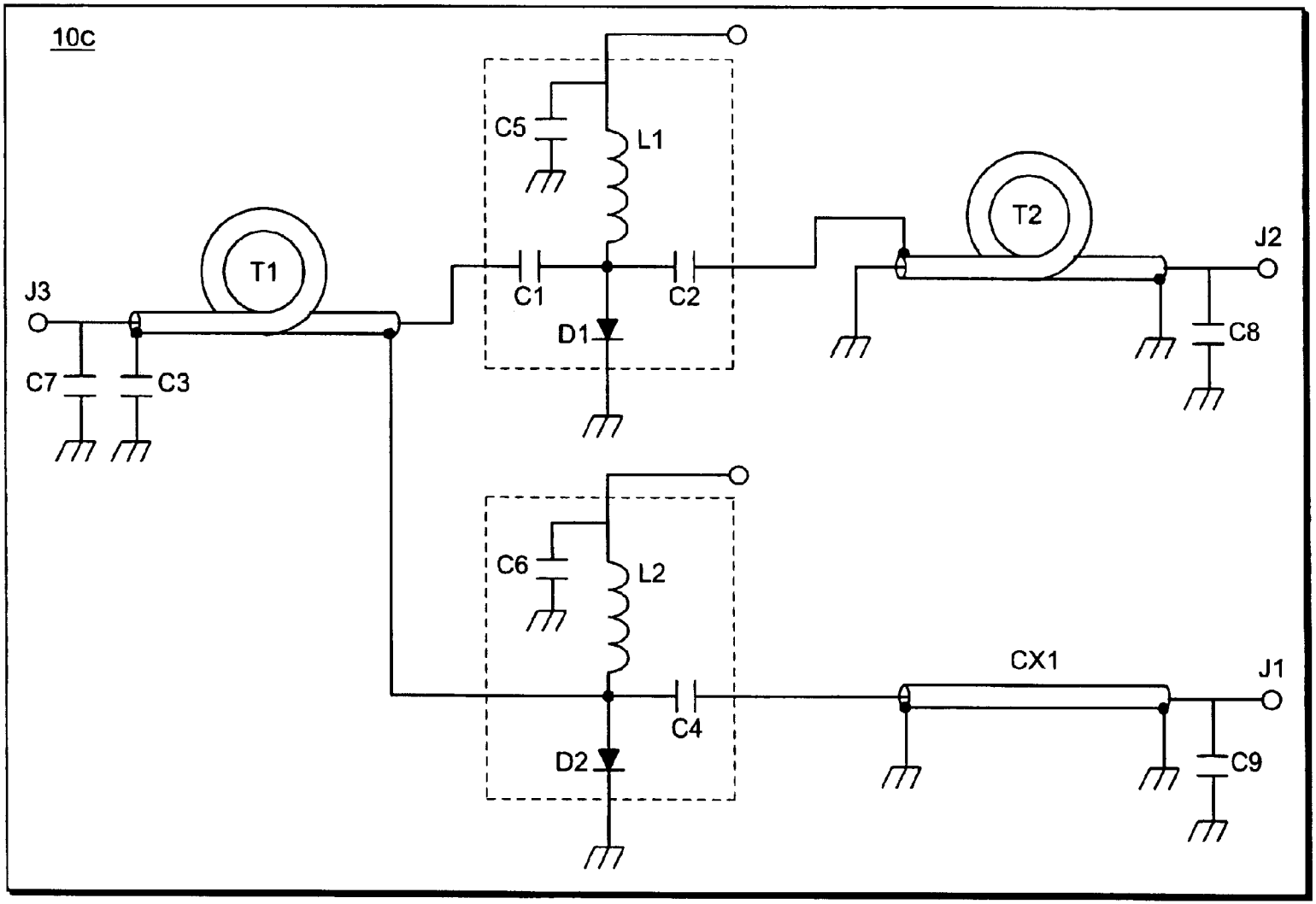
FIG. 6 is a electrical component schematic drawing of yet another embodiment of the RF switch according to the present invention.

In yet another embodiment, the dual output RF switch 10*c*, FIG. 6, provides a circuit having a better physical layout. In this embodiment, first capacitor C3 in the second biasing circuit is moved to the ground port of input J3. This is electrically the same position as previously shown. In addition, this circuit adds additional DC current blocking capacitors C5–C9. In this embodiment, T1 and T2 are constructed using several turns of a set impedance of coaxial cable on one or several cores. The length of the coaxial cable can be approximately several inches ground to ground, but can be very short when operating in the GHz range. The third transformer, labeled CX1, consists of similar length of said coaxial cable. Further, capacitor C1, C2, C5, and C6 consist of several picofarads each. C4 and C3 are bypassing capacitor and may consist of one or many capacitors having a reasonably large value while C7, C8 and C9 only need to be small and are part of the impedance matching. L1 and L2 can be made of several turns of any type of small gauge wire on a any ferrite or iron powder core while two or more pairs of PIN diodes are employed.

Figure 7:
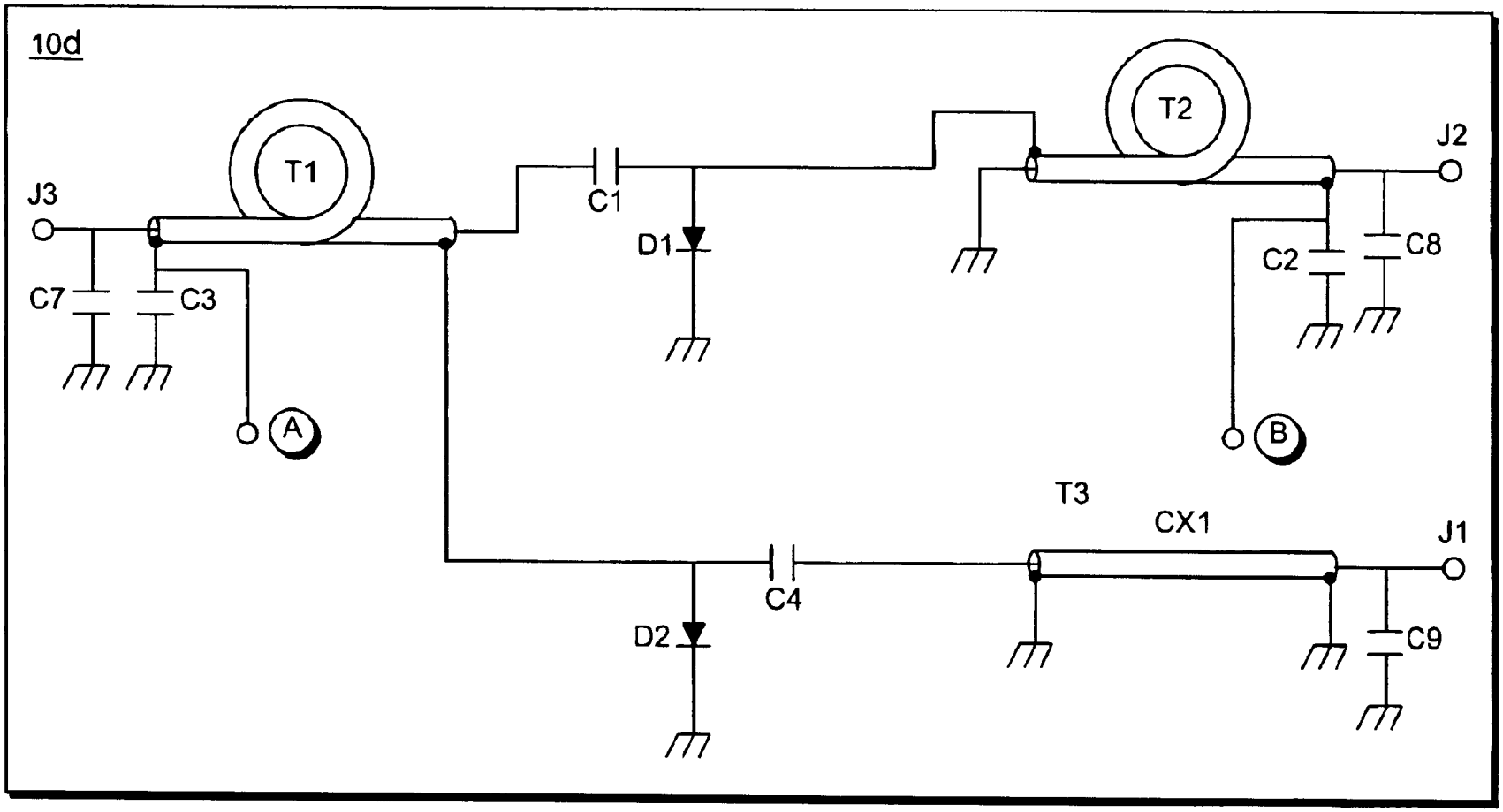
FIG. 7 is an electrical component schematic drawing of still another embodiment of the RF switch according to the present invention.

In yet a further embodiment of the present invention, 10*d*, FIG. 7, capacitor C2 has been moved to the ground side of T2. Now the inductors L1 and L2 can be removed by placing the control signal drive points at "a" and "b" as shown. Capacitor C6 then merges into C3, and capacitor C5 merges into C2. This changes is possible because the inductance of T1 and T2 provide the RF isolation for the bias drive points "a" and "b".

The removal of the inductors T1 and T2 is instrumental in the absence of any ringing, as the switching signal applied to ports "a" and "b" are a 'first order' response due solely to the charging and discharging of capacitors C2 and C3.

Accordingly, the present invention provides a novel dual channel RF switch which has broadband capabilities and which utilizes PIN diodes as biasing elements that are not in the direct RF switch path. Other novel features and advantages are found in the present invention.

Modifications and substitutions by one of ordinary skill in the art are considered to be within the scope of the present invention, which is not to be limited except by the following claims.

The invention claimed is:

1. An RF switch comprising:

a first transformer having an input port for receiving an RF input signal, and an output port for providing said RF input signal;

a first output port biasing circuit, electrically coupled to said transformer, for receiving said RF input signal, and responsive to a first output port biasing circuit control signal, for selectively operating said first output port biasing circuit in one of either a biased condition or an unbiased condition, for providing said RF input signal to a first output port in said biased condition, and for providing a high impedance to said output port in said unbiased condition; and a second output port biasing circuit, electrically coupled to said transformer for receiving said RF input signal, and responsive to a second output port biasing circuit control signal, for selectively operating said second output port biasing circuit in one of either a biased condition or an unbiased condition, for providing said RF input signal to a second output port in said biased condition, and for providing a high impedance to said output port in said unbiased condition wherein said each of first and second output port biasing circuits include a variable resistive biasing element through which said RF signal does not flow.

2. The RF switch of claims 1 wherein said first transformer is a BALUN transformer.

3. The RF switch of claim 1 wherein said biasing element through which said RF signal does not flow includes a PIN diode.

4. The RF switch of claim 3 wherein each of said first and second output port biasing circuits include first and second DC current blocking capacitors.

5. The RF switch of claim 4 wherein each of said first and second output port biasing circuits include a bias injection inductor.

6. The RF switch of claim 5 wherein each of said first and second output port biasing circuits include said injection inductor electrically connected to said PIN diode and coupled to said first or second output port biasing circuit control signal inputs and a first end of a PIN diode, and wherein said first DC current blocking capacitor is disposed between said first transformer output and said electrical connection of said injunction inductor and said PIN diode, and wherein said second DC current blocking capacitor is disposed between said electrical connection of said injunction inductor and said PIN diode and said first or second output port.

7. The RF switch of claim 6 wherein said first DC current blocking capacitor in said second output biasing circuit is electrically connected between a ground side of said first transformer input port and ground; and further including a fourth DC current blocking capacitor disposed between said first transformer input port and ground.

8. The RF switch of claim 7 wherein each of said first and second output port biasing circuits include a third DC blocking capacitor electrically connected between an input port of each of said injection inductors and ground.

9. The RF switch of claim 1 further including a second transformer, electrically coupled to said first output port biasing circuit, for receiving said RF input signal and for providing said RF input signal to said first output port; and said RF switch further including a third transformer, electrically coupled to said second output port biasing circuit, for receiving said RF input signal and for providing said RF input signal to said second output port.

10. The RF switch of claim 9 wherein said first, second, and third transformers are BALUN transformers.

11. The RF switch of claim 9 wherein said first transformer is a broadband ferrite loaded transformer wound with coaxial cable, wherein said second transformer is a broadband ferrite loaded transformer wound with coaxial cable, and wherein said third transformer is a coaxial cable having a length selected such that a phase of said RF signal provided at said second output port is the same as a phase of said RF signal provided at said first output port.

12. The RF switch of claim 11 wherein each of said first and second output port biasing circuits include first and second DC current blocking capacitors.

13. The RF switch of claim 12 wherein each of said first and second output port biasing circuits include a bias injection inductor.

14. The RF switch of claim 13 wherein each of said first and second output port biasing circuits include said injection inductor electrically connected to said PIN diode and coupled to said first or second output port biasing circuit control signal inputs and a first end of a PIN diode, and wherein said first DC current blocking capacitor is disposed between said first transformer output and said electrical connection of said injunction inductor and said PIN diode, and wherein said second DC current blocking capacitor is disposed between said electrical connection of said injunction inductor and said PIN diode and said first or second output port.

15. The RF switch of claim 14 wherein said first DC current blocking capacitor in said second output biasing circuit is electrically connected between a ground side of said first transformer input port and ground; and further including a fourth DC current blocking capacitor disposed between said first transformer input port and ground.

16. The RF switch of claim 15 wherein each of said first and second output port biasing circuits include a third DC blocking capacitor electrically connected between an input port of each of said injection inductors and ground.

17. The RF switch of claim 16 wherein said first and second output ports include a fourth DC current blocking capacitor electrically coupled between said first and second output ports and ground.

18. The RF switch of claim 11 further including a first DC current blocking capacitor in said second output port biasing circuit disposed between a ground side of said first transformer input port and ground, and wherein said second output port biasing circuit control signal is electrically connected between the ground side of said input port of said first transformer and said first DC current blocking capacitor;

a fourth DC current blocking capacitor, electrically coupled between said first transformer input port and ground;

wherein said first output port biasing circuit includes said first DC current blocking capacitor electrically coupled between an output port or said first transformer and a first end of a PIN diode, and wherein said second end of said PIN diode is connected to ground;

wherein said second output port biasing circuit includes a second DC current blocking capacitor electrically coupled between a first end of a PIN diode and an input port of said third transformer, and wherein a second end of said PIN diode is coupled to ground;

wherein said first and second output ports include a fourth DC current blocking capacitor electrically coupled between said first and second output ports and ground; and further including a fifth DC current blocking capacitor, electrically coupled between a ground side of said second transformer and ground, and wherein said first output port biasing circuit control signal is electrically connected between said ground side of said second transformer and said fifth DC current blocking capacitor.

19. The RF switch of claim 1 wherein said first transformer is a broadband ferrite loaded transformer wound with coaxial cable.

20. The RF switch of claim 1 wherein each of said first and second output port biasing circuits includes at least one DC current blocking capacitor.

21. The RF switch of claim 1 further including an output port biasing circuit control signal generator, for selectively generating said first and second output port biasing circuit control signals, wherein said output port biasing circuit control signal generator generates only one of said first or second output port biasing circuit control signals at any one time, thereby biasing one of said first or second output port biasing circuits while simultaneously unbiasing the other of said first or second output port biasing circuits.

22. An RF switch comprising:

a first BALUN transformer having an input port for receiving an RF input signal, and an output port for providing said RF input signal;

a first output port biasing circuit, electrically coupled to said transformer for receiving said RF input signal, and responsive to a first output port biasing circuit control signal for selectively operating said first output port biasing circuit in one of either a biased condition or an unbiased condition, for providing said RF input signal to a first output port in said biased condition, and for providing a high impedance to said output port in said unbiased condition, wherein said first output port biasing circuit includes a first PIN diode biasing element through which said RF signal does not flow, said first output port biasing circuit also including at least first and second DC current blocking capacitors and a first bias injection inductor, wherein said bias injection inductor is electrically connected to said first PIN diode and coupled to said first output port biasing circuit control signal input and a first end of said first PIN diode, and wherein said first DC current blocking capacitor is disposed between said first BALUN transformer output and said electrical connection of said bias injection inductor and said first PIN diode, and wherein said second DC current blocking capacitor is disposed between said electrical connection of said injection inductor and said first PIN diode and said first output port; and a second output port biasing circuit, electrically coupled to said transformer for receiving said RF input signal, and responsive to a second output port biasing circuit control signal for selectively operating said second output port biasing circuit in one of either a biased condition or an unbiased condition, for providing said RF input signal to a second output port in said biased condition, and for providing a high impedance to said output port in said unbiased condition, wherein said second output port biasing circuit includes a second PIN diode biasing element through which said RF signal does not flow, said second output port biasing circuit also including at least first and second DC current blocking capacitors and a second bias injection inductor, wherein said second bias injection inductor is electrically connected to said second PIN diode and coupled to said second output port biasing circuit control signal input and a first end of said second PIN diode, and wherein said first DC current blocking capacitor is disposed between said first BALUN transformer output and said electrical connection of said second bias injection inductor and said second PIN diode, and wherein said second DC current blocking capacitor is disposed between said electrical connection of said second injection inductor and said second PIN diode and said second output port.

23. An RF switch comprising:

a first transformer having an input port for receiving an RF input signal, and an output port for providing said RF input signal;

a first output port biasing circuit, electrically coupled to said transformer for receiving said RF input signal, and responsive to a first output port biasing circuit control signal for selectively operating said first output port biasing circuit in one of either a biased condition or an unbiased condition, for providing said RF input signal to a first output port in said biased condition, and for providing a high impedance to said output port in said unbiased condition;

a second output port biasing circuit, electrically coupled to said transformer for receiving said RF input signal, and responsive to a second output port biasing circuit control signal for selectively operating said second output port biasing circuit in one of either a biased condition or an unbiased condition, for providing said RF input signal to a second output port in said biased condition, and for providing a high impedance to said output port in said unbiased condition;

an output port biasing circuit control signal generator, for selectively generating said first and second output port biasing circuit control signals, wherein said output port biasing circuit control signal generator generates only one of said first or second output port biasing circuit control signals at any one time, thereby biasing one of said first or second output port biasing circuits while simultaneously unbiasing the other of said first or second output port biasing circuits; further including a second BALUN transformer, electrically coupled to said first output port biasing circuit, for receiving said RF input signal and for providing said RF input signal to said first output;

a third BALUN transformer, electrically coupled to said second output port biasing circuit, for receiving said RF input signal and for providing said RF input signal to said first output; and wherein each of said first and second output port biasing circuits include at least one DC current blocking capacitor.

24. An RF switch comprising:

a first transformer having an input port for receiving an RF input signal, and an output port for providing said RF input signal, a second transformer and a third transformer, wherein said first transformer is a broadband ferrite loaded transformer wound with coaxial cable, wherein said second transformer is a broadband ferrite loaded transformer wound with coaxial cable, and wherein said third transformer is a coaxial cable having a length selected such that a phase of said RF signal provided at said second output port is the same as a phase of said RF signal provided at said first output port;

a first output port biasing circuit, electrically coupled to said transformer for receiving said RF input signal, and responsive to a first output port biasing circuit control signal for selectively operating said first output port biasing circuit in one of either a biased condition or an unbiased condition, for providing said RF input signal to a first output port in said biased condition, and for providing a high impedance to said output port in said unbiased condition;

a second output port biasing circuit, electrically coupled to said transformer for receiving said RF input signal, and responsive to a second output port biasing circuit control signal for selectively operating said second output port biasing circuit in one of either a biased condition or an unbiased condition, for providing said RF input signal to a second output port in said biased condition, and for providing a high impedance to said output port in said unbiased condition;

wherein each of said first and second output port biasing circuits include first and second DC current blocking capacitors and a bias injection inductor; and wherein each of said first and second output port biasing circuit including said injection inductor electrically connected to a PIN diode and coupled to said first or second output port biasing circuit control signal input and a first end of said PIN diode, and wherein said first DC current blocking capacitor is disposed between said first transformer output and said electrical connection of said injunction inductor and said PIN diode, and wherein said second DC current blocking capacitor is disposed between said electrical connection of said injunction inductor and said PIN diode and said first or second output port.

25. An RF switch comprising:

a first transformer having an input port for receiving an RF input signal, and an output port for providing said RF input signal, a second transformer and a third transformer, wherein said first transformer is a broadband ferrite loaded transformer wound with coaxial cable, wherein said second transformer is a broadband ferrite loaded transformer wound with coaxial cable, and wherein said third transformer is a coaxial cable having a length selected such that a phase of said RF signal provided at said second output port is the same as a phase of said RF signal provided at said first output port;

a first output port biasing circuit, electrically coupled to said transformer for receiving said RF input signal, and responsive to a first output port biasing circuit control signal for selectively operating said first output port biasing circuit in one of either a biased condition or an unbiased condition, for providing said RF input signal to a first output port in said biased condition, and for providing a high impedance to said output port in said unbiased condition;

a second output port biasing circuit, electrically coupled to said transformer for receiving said RF input signal, and responsive to a second output port biasing circuit control signal for selectively operating said second output port biasing circuit in one of either a biased condition or an unbiased condition, for providing said RF input signal to a second output port in said biased condition, and for providing a high impedance to said output port in said unbiased condition;

wherein each of said first and second output port biasing circuits include first and second DC current blocking capacitors and a bias injection inductor, and wherein said first DC current blocking capacitor in said second output biasing circuit is electrically connected between a ground side of said first transformer input port and ground; and further including a fourth DC current blocking capacitor disposed between said first transformer input port and ground;

wherein each of said first and second butput port biasing circuit including said injection inductor electrically connected to a PIN diode and coupled to said first or second output port biasing circuit control signal input and a first end of said PIN diode, and wherein said first DC current blocking capacitor is disposed between said first transformer output and said electrical connection of said injunction inductor and said PIN diode, and wherein said second DC current blocking capacitor is disposed between said electrical connection of said injunction inductor and said PIN diode and said first or second output port; and wherein each of said first and second output port biasing circuits include a third DC blocking capacitor electrically connected between an input port of each of said injection inductors and ground.

26. An RF switch comprising:

a first transformer having an input port for receiving an RF input signal, and an output port for providing said RF input signal, a second transformer and a third transformer, wherein said first transformer is a broadband ferrite loaded transformer wound with coaxial cable, wherein said second transformer is a broadband ferrite loaded transformer wound with coaxial cable, and wherein said third transformer is a coaxial cable having a length selected such that a phase of said RF signal provided at said second output port is the same as a phase of said RF signal provided at said first output port;

a first output port biasing circuit, electrically coupled to said transformer for receiving said RF input signal, and responsive to a first output port biasing circuit control signal for selectively operating said first output port biasing circuit in one of either a biased condition or an unbiased condition, for providing said RF input signal to a first output port in said biased condition, and for providing a high impedance to said output port in said unbiased condition;

a second output port biasing circuit, electrically coupled to said transformer for receiving said RF input signal, and responsive to a second output port biasing circuit control signal for selectively operating said second output port biasing circuit in one of either a biased condition or an unbiased condition, for providing said RF input signal to a second output port in said biased condition, and for providing a high impedance to said output port in said unbiased condition;

an output port biasing circuit control signal generator, for selectively generating said first and second output port biasing circuit control signals, wherein said output port biasing circuit control signal generator generates only one of said first or second output port biasing circuit control signals at any one time, thereby biasing one of said first or second output port biasing circuits while simultaneously unbiasing the other of said first or second output port biasing circuits;

wherein each of said first and second output port biasing circuits include at least a first DC current blocking capacitors;

wherein said second output port biasing circuit includes said first DC current blocking capacitor disposed between a ground side of said first transformer input port and ground, and wherein said second output port biasing circuit control signal is electrically connected between the ground side of said input port of said first transformer and said first DC current blocking capacitor;

wherein said first output port biasing circuit includes said first DC current blocking capacitor electrically coupled between an output port of said first transformer and a first end of a PIN diode, and wherein said second end of said PIN diode is connected to ground;

wherein said second output port biasing circuit includes a second DC current blocking capacitor electrically coupled between a first end of a PIN diode and an input port of said third transformer, and wherein a second end of said PIN diode is coupled to ground;

wherein each of said first and second output ports include a fourth DC current blocking capacitor electrically coupled between said first and second output ports and ground; and further including a fifth DC current blocking capacitor, electrically coupled between a ground side of said second transformer and ground, and wherein said first output port biasing circuit control signal is electrically connected between said ground side of said second transformer and said fifth DC current blocking capacitor.

27. An RF switch comprising:

a first BALUN transformer having an input port for receiving an RF input signal, and an output port for providing said RF input signal;

a first output port biasing circuit, electrically coupled to said transformer for receiving said RF input signal, and responsive to a first output port biasing circuit control signal for selectively operating said first output port biasing circuit in one of either a biased condition or an unbiased condition, for providing said RF input signal to a first output port in said biased condition, and for providing a high impedance to said output port in said unbiased condition;

a second output port biasing circuit, electrically coupled to said transformer for receiving said RF input signal, and responsive to a second output port biasing circuit control signal for selectively operating said second output port biasing circuit in one of either a biased condition or an unbiased condition, for providing said RF input signal to a second output port in said biased condition, and for providing a high impedance to said output port in said unbiased condition;

an output port biasing circuit control signal generator, for selectively generating said first and second output port biasing circuit control signals, wherein said output port biasing circuit control signal generator generates only one of said first or second output port biasing circuit control signals at any one time, thereby biasing one of said first or second output port biasing circuits while simultaneously unbiasing the other of said first or second output port biasing circuits; and wherein each of said first and second output port biasing circuits include a biasing element through which said RF signal does not flow, said biasing element including a PIN diode.

28. An RF switch comprising:

a first transformer having an input port for receiving an RF input signal, and an output port for providing said RF input signal, a second transformer and a third transformer, wherein said first transformer is a broadband ferrite loaded transformer wound with coaxial cable, wherein said second transformer is a broadband ferrite loaded transformer wound with coaxial cable, and wherein said third transformer is a coaxial cable having a length selected such that a phase of said RF signal provided at said second output port is the same as a phase of said RF signal provided at said first output port;

a first output port biasing circuit, electrically coupled to said transformer for receiving said RF input signal, and responsive to a first output port biasing circuit control signal for selectively operating said first output port biasing circuit in one of either a biased condition or an unbiased condition, for providing said RF input signal to a first output port in said biased condition, and for providing a high impedance to said output port in said unbiased condition;

a second output port biasing circuit, electrically coupled to said transformer for receiving said RF input signal, and responsive to a second output port biasing circuit control signal for selectively operating said second output port biasing circuit in one of either a biased condition or an unbiased condition, for providing said RF input signal to a second output port in said biased condition, and for providing a high impedance to said output port in said unbiased condition; and wherein each of said first and second output port biasing circuits include a biasing element through which said RF signal does not flow, said biasing element including a PIN diode.

29. An RF switch comprising:

a transformer having an input port for receiving an RF input signal, and an output port for providing said RF input signal;

a first output port biasing circuit, electrically coupled to said output port of said transformer, for receiving said RF input signal, and responsive to a first output port biasing circuit control signal, for selectively operating said first output port biasing circuit in one of either a biased condition or an unbiased condition, for providing said RF input signal to an output port of said first output port biasing circuit in said biased condition, and for providing a high impedance to said output port in said unbiased condition;

a second output port biasing circuit, electrically coupled to said output port of said transformer for receiving said RF input signal, and responsive to a second output port biasing circuit control signal, for selectively operating said second output port biasing circuit in one of either a biased condition or an unbiased condition, for providing said RF input signal to a output port of said second output port biasing circuit in said biased condition, and for providing a high impedance to said output port in said unbiased condition; and wherein each of said first and second output port biasing circuits include a bias injection inductor coupled after said output port of said transformer and prior to, respectively, each of said output port for said first output port biasing circuit and said second output port biasing circuit.

* * * * *